US005983779A

United States Patent [19]

Romanco

[11] Patent Number: 5,983,779

[45] Date of Patent: Nov. 16, 1999

[54] POSITIVE DISPLACEMENT PUMP FOR LIQUID AND GASES

[76] Inventor: Ernest Kenneth Romanco, 661 N. Concord Rd., Albion, Mich.

[21] Appl. No.: 09/065,328

[22] Filed: Apr. 23, 1998

[51] Int. Cl.[6] ..... F01B 29/04

[52] U.S. Cl. ..... 92/59; 92/128; 92/146; 92/161

[58] Field of Search ..... 92/128, 129, 59, 92/146, 147, 161; 417/273, 221; 74/55

[56] References Cited

U.S. PATENT DOCUMENTS

| | | | |
|---|---|---|---|
| 1,695,721 | 12/1928 | Smith | 417/221 |
| 3,185,042 | 5/1965 | Hastings | 92/128 |
| 4,534,272 | 8/1985 | Irwin | 74/55 |
| 4,621,566 | 11/1986 | Johnson et al. | 92/128 |

OTHER PUBLICATIONS

Special Services, $CO_2$ Pump Schematic, c.1981.

CS&P Cryogenics, Inc. Pump Brochure, Houston, Texas c. 1989.

Hydro–Test Products, Inc., Engineered Service Equipment, "Model SC–5 Carbon Dioxide—Nitrous Oxide—Liquid Halon Transfer Unit" brocures, 1987 Stow, Massachusetts.

Woodland Cryogenics Inc., Instruction Manual W50 $CO_2$/$N_2O$ Pump, Philadelphia, Pennsylvania, 1989.

CARDOX, Operation and Service Manual Carbon Dioxide Cylinder Filling Unit, S/N 1–042–0050, pp. 1–16, c. 1980's.

*Primary Examiner*—Thomas E. Denion

*Attorney, Agent, or Firm*—Young & Basile, P.C.

[57] ABSTRACT

A positive displacement type pump used for applications such as pressurizing beverage dispensing containers, filling fire extinguishers, and pressuring welding tanks. $CO_2$ or similar fluids are drawn into and discharged through the pump by a reciprocating piston driven by a rotating eccentric main bearing mounted on a bearing frame. The bearing frame comprises an open, unsealed pair of structural plates connected by tie rods, the main bearing itself being sealed by one of two seal arrangements to make it easily convertible between oil-lubricated and oil-free operation. For oil-lubricated operation, the main bearing is supplied with a surrounding sealed bearing sleeve compressed between the plates of the bearing frame. For oil-free operation, the main bearing is internally sealed. The main bearing is driven by a shaft supported on bearings in the plates, the bearings also being changeable between sealed and unsealed bearings for oil-free and oil-lubricated operations, respectively.

10 Claims, 6 Drawing Sheets

POSITIVE DISPLACEMENT PUMP FOR LIQUID AND GASES

FIELD OF THE INVENTION

This invention is in the field of positive displacement pumps for fluids, and more particularly in the field of pumps designed to pump $CO_2$ and similar fluids for applications such as filling pressurized cylinders for beverage use, pressurizing fire extinguisher cylinders and systems, and filling welding supply tanks.

BACKGROUND OF THE INVENTION

Pumps designed for pumping fluids such as liquid $CO_2$ (carbon dioxide) are well known in the art. Such pumps are often used for the purpose of filling cylinders used in the beverage dispensing, fire extinguishing and welding industries. These pumps are typically self-contained units connected by intake and discharge tubing to a supply tank and to a cylinder which is to be filled and pressurized by the pump. The pumps typically include a sealed crankcase housing containing a shaft-driven bearing which reciprocates a piston in a cylinder, with a pump head mounted on one end of the housing to draw $CO_2$ from the supply tank through an intake valve and to discharge it on the compression stroke through a discharge valve. Especially in food grade, medical, laboratory and welding applications, the pump housing must be carefully sealed to prevent lubricating oil from contaminating the cylinder being filled. The crankcase housings for the pumps have typically been costly to manufacture and difficult to seal, comprising large, relatively complicated cast or machined parts.

In food grade applications it is actually preferred to use oil-free pumps because of the risk of oil contamination, and for this purpose manufacturers typically offer both oil-using and oil-free pumps to their customers, depending on the application. Manufacturing two different styles of pump for oil-lubricating and oil-free use increases cost both to the manufacturer and to the customer.

SUMMARY OF THE INVENTION

The present invention is an improved positive displacement pump for liquids and gases, particularly designed for fluid pumping applications of the cylinder-filling type described above. In general, the invention resides in an improved housing and sealing arrangement for the main drive shaft and main bearing. Rather than a complicated, cast sealed housing, the present invention uses one of two different seal arrangements for the main bearing, each of which is compatible with a simple plate-and-bolt bearing support frame. By selecting from one of two main bearing seal arrangements, the manufacturer or end user can configure the pump for oil-lubricated operation, or for oil-free operation in food grade and other oil-sensitive applications.

In a first oil-lubricated embodiment, the main bearing is provided with an external seal comprising a cylindrical sleeve with end seals trapped between front and rear plates of the frame. In a second oil-free embodiment, the main bearing is internally sealed and the external sealing sleeve is removed.

The bearing frame comprises simple front and rear plates which are connected by drawbolts or similar tie-rod type fasteners located around both the main bearing and the cylindrical sealing sleeve. The frame plates are adapted to support the main shaft on bearings of conventional type. However, the bearing mounting portions of the plates are configured to interchangeably accept both "open" type bearings for use in an oil-lubricated configuration, and sealed bearings for oil-free configuration.

In a further embodiment of the invention, the main bearing is self-aligning and the piston floats on the bearing under pressure from the pump head, a feature not found on prior art pumps. This feature allows great latitude in machine tolerance thus cutting cost and assuring a positive perpendicular bearing surface between the piston and bearing. This also minimizes any load between piston and cylinder.

It will be apparent to those skilled in the art that the inventive open frame and interchangeable bearing arrangements eliminate the need for an expensive crankcase, thereby offering the advantage of reduced cost and complexity in addition to interchangeability between oil-lubricated and oil-free operation. These and other features and advantages of the invention will become apparent upon further reading, in light of the accompanying drawings.

DETAILED DESCRIPTION OF THE ILLUSTRATED EMBODIMENTS

Figure 1:
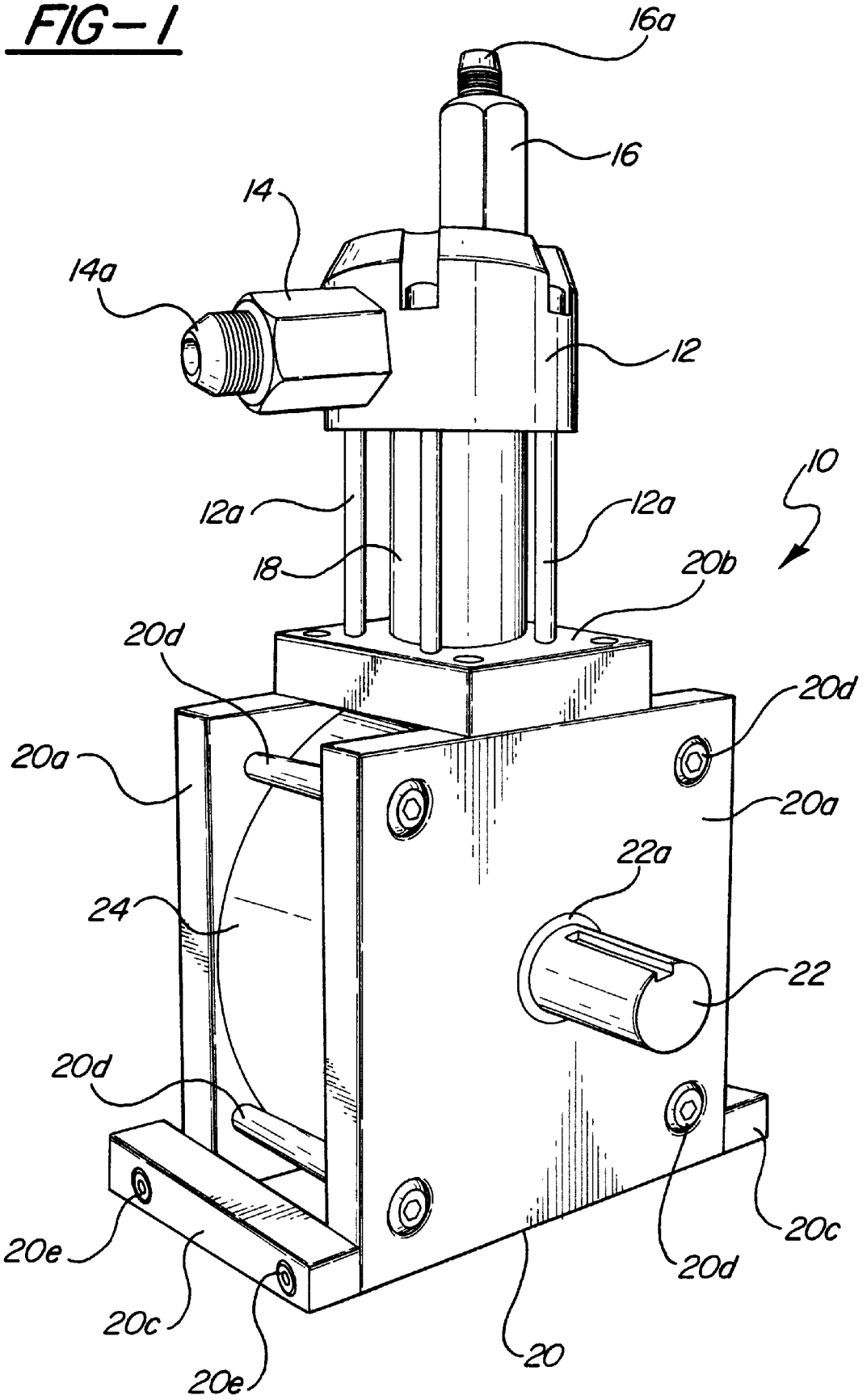
FIG. 1 is a front perspective view of a pump according to the present invention.

Referring first to FIG. 1, a pump according to the present invention is generally denoted by reference numeral 10. Pump 10 includes a fairly standard pump head 12 with intake and discharge valving 14, 16 of a commercially available type. Valve fittings 14, 16 are shown with threaded intake and discharge nozzles 14*a*, 16*a* to which fluid lines are connected from and to a supply tank and a cylinder or other device being filled. A preferred use for pump 10 according to the present invention is for pumping $CO_2$ from a supply tank to a device such as a pressurized beverage cylinder, a welding gas cylinder, fire extinguisher or other known $CO_2$-using pressure device.

A piston (FIG. 2) reciprocates in cylinder 18 to alternately draw the pressurized fluid from the supply through intake valving 14 into the pump head, and then discharge it on the compression stroke through discharge valving 16 to the cylinder. The operation of the piston and pump head is controlled by a rotating, piston-driving main bearing in bearing frame 20, which is where the present invention resides.

Bearing frame 20 replaces the typical cast and sealed crankcase found in prior art pumps. Rather than an expensive, complicated cast housing with integrated seals, inventive bearing frame 20 comprises a simple bolt-together array of plate members. Illustrated bearing frame 20 includes front and rear plates 20*a* held together by drawbolts or tie rods 20*d*. Pump head 12 is mounted to a top plate 20*b*, which is preferably bolted to the upper edges of plates 20*a*. Additional stability may be provided by optional end feet 20*c*, also preferably bolted to plates 20*a* with bolts 20*e*.

While the illustrated frame plates and many other parts of the pump are illustrated as being made from steel, those skilled in the art will recognize that other metals such as aluminum can be used, depending on the pump's intended use.

The piston-driving main bearing is located between plates 20*a* within the periphery of structural drawbolts 20*d*, rotated by a standard spline shaft 22 driven by a motor (not shown) of known type. The only seals required in frame 20 itself are at the points where the main shaft 22 penetrates front and rear plates 20*a*, with one such seal generally indicated at 22*a* on the "front" plate from which the driven end of shaft 22 extends.

The simple bolt-together plate design of inventive bearing frame 20 permits pump 10 to be adapted quickly and easily between two modes of operation: oil-lubricated and oil-free, achieved simply by changing the sealing arrangement of the main bearing and, if desired, the shaft bearings. In FIG. 1, pump 10 is shown adapted for oil-lubricated operation in which the main bearing is provided with a sealed bearing sleeve 24 comprising a short length of large diameter steel tubing surrounding the main bearing and held between the inside faces of front and rear plates 20*a*. Bearing sleeve 24 is provided with its own integral seals on each circular face thereof, for example fitted into a circular slot or groove in a compression fit. The opposing interior faces of front and rear plates 20*a* may also be provided with a circular groove or slot matching the diameter and wall thickness of sleeve 24 for a mechanical as well as a sealing interconnection between them, although depending on the type of seals on sleeve 24 it is be possible in some applications to simply compress the sealed circular faces of sleeve 24 between plates 20*a* with drawbolts 20*d* to create a sufficient sealing fit.

It will be noted from FIG. 1 that the diameter of sleeve 24 lies within the periphery of drawbolts 20*d*, relieving the structural frame members from the need for sealing when the pump is used for oil-lubricated operation. It will be apparent to those skilled in the art that by placing a small amount of oil in the bottom of sleeve 24, sufficient for the eccentrically mounted main bearing to splash during rotation, the pump can be operated with continuous lubrication to the bearing and piston within the sleeve.

Figure 2:
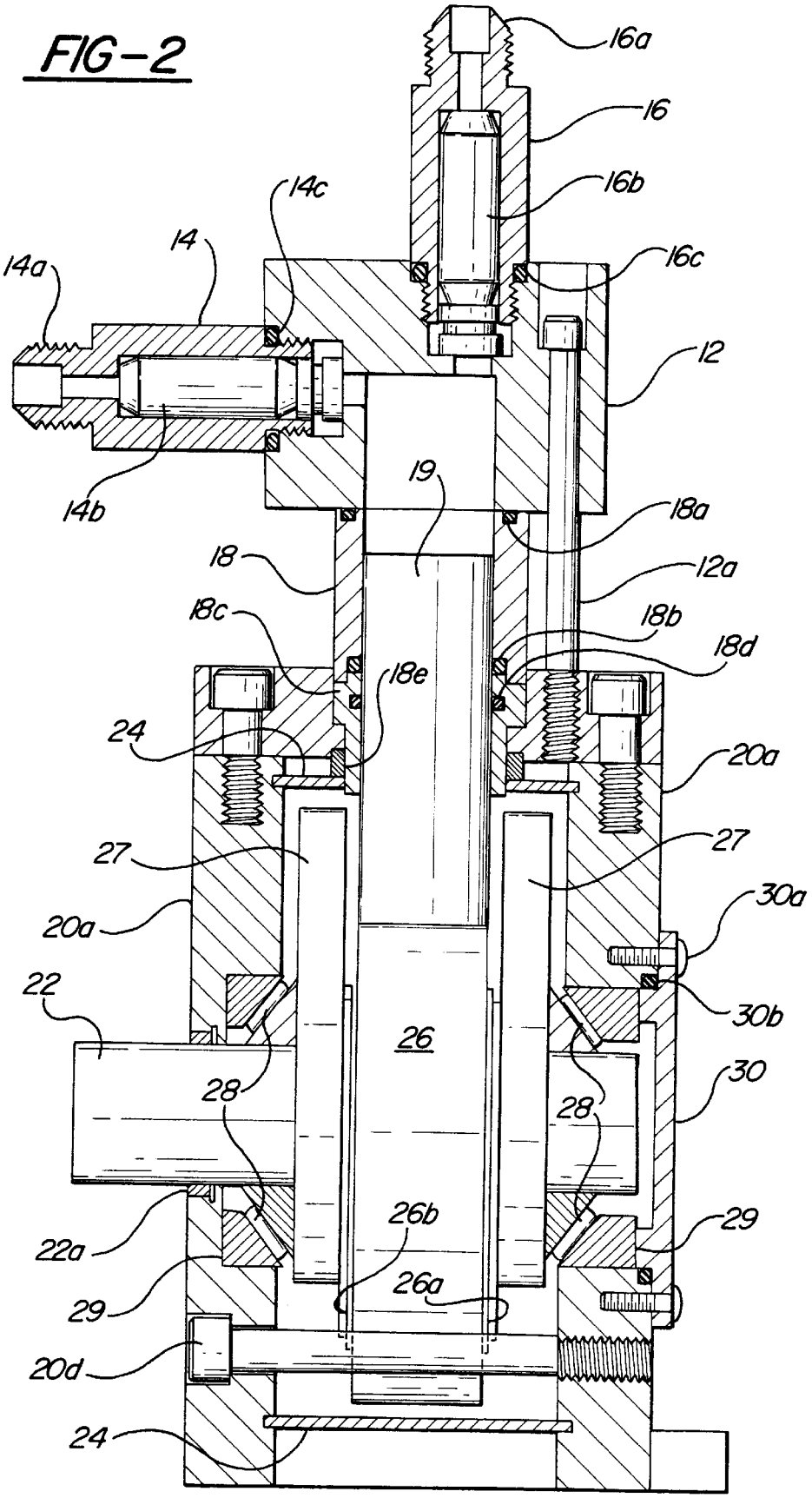
FIG. 2 is an end sectional view of the pump according to the present invention, with the pump head rotated 90° for clarity, showing the pump adapted for oil-lubricated operation with a sleeve-type external bearing seal.

Referring now to FIG. 2, the pump of FIG. 1 is illustrated in end section view, still adapted for oil-lubricated operation using sealed bearing sleeve 24. Cylinder 18 is itself sealed with respect to pump head 12 with an O-ring seal 18*a* at its upper end, and is further sealed against piston 19 and guide bushing 18*c* with a single pressure seal 18*b*, eliminating the layers of packing used in prior art pumps at this juncture. Guide bushing 18*c* also includes an oil seal 18*d* which wipes piston 19 as it reciprocates within the bushing. At its lower end, guide bushing 18*c* also preferably includes a neoprene or elastomer type seal 18*e* where it penetrates bearing sleeve 24. Through a suitably formed opening at the top of the sleeve.

Figure 6:
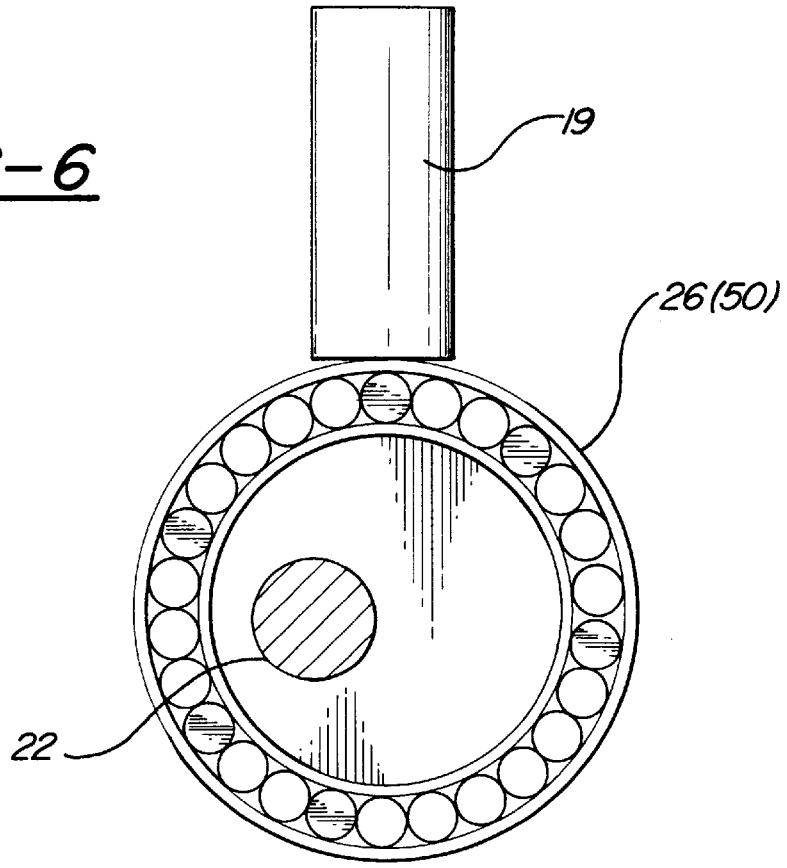
FIG. 6 is a side section view of the main bearing of FIG. 4, illustrating its contact with the pump piston; and, FIGS. 6A and 6B are schematic representations of non-self-aligning and self-aligning bearings responding to piston offset.
Figure 6A:
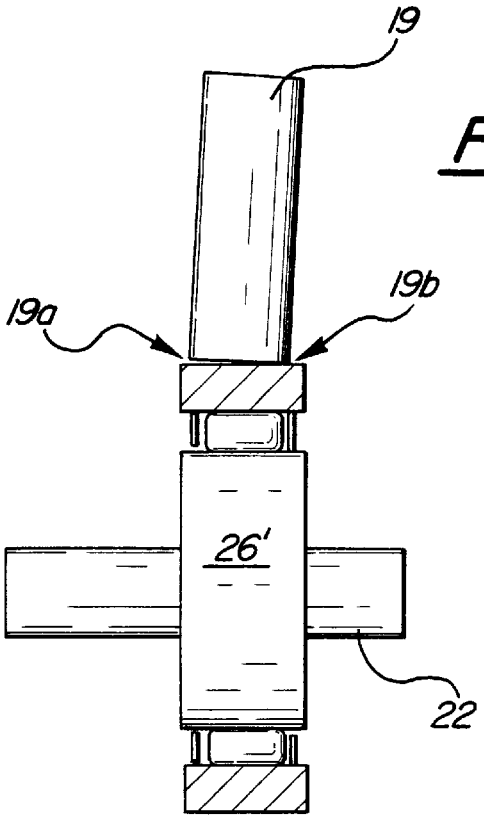
Figure 6B:
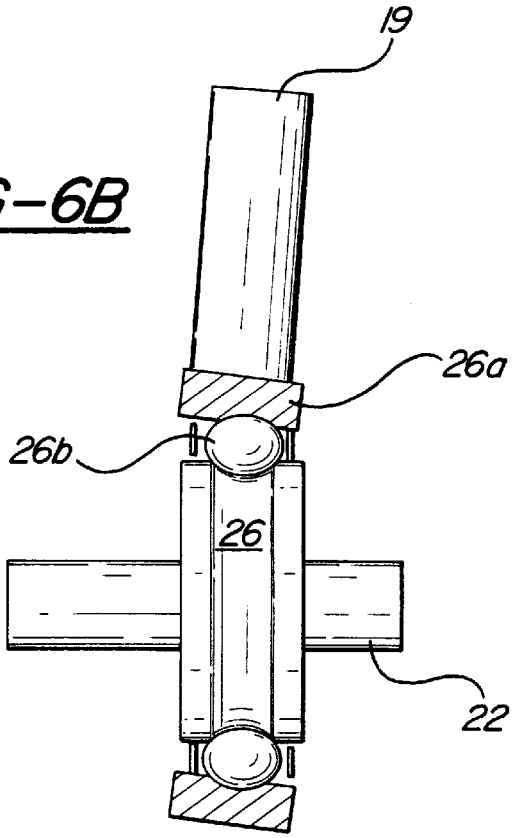

Main bearing 26 is mounted on shaft 22 with eccentric and retaining ring structure 26*a*, 26*b*, and further includes counterweights 27. Main bearing 26 in the oil-lubricated, sleeved version of the invention illustrated in FIG. 2 is an unsealed but preferably self-aligning bearing of a commercially available type, for example a spherical or ball roller bearing as best illustrated in FIG. 6. The use of a self-aligning bearing to drive a piston in a $CO_2$ pump of the type shown in FIGS. 1 and 2 is believed to be previously unknown in the art. Referring to FIG. 6A, a non-self-aligning bearing 26' is illustrated schematically to show that any offset of the piston 19 results in a gap at 19*a* and a "point" contact at 19*b* since the outer race cannot swivel. In contrast, with the self-aligning bearing 26 illustrated in FIG. 6B, the outer race 26*a* can swivel a few degrees, and any offset caused by machining tolerances can be compensated for by the outer race being able to pivot a few degrees on the rollers 26*b*, thus allowing perfect alignment and even transmission of force to the piston and eliminating any side thrust on the piston which would then be transmitted to the cylinder walls causing rapid wear. This then allows more tolerance in machining, thus reducing cost.

Shaft 22 is rotatably supported on front and rear frame plates 20*a* by unsealed shaft bearings 28, such as the commercially available Timnken type. Like main bearing 26, shaft bearings 28 are lubricated by the continual splashing of lubricating oil caused by the eccentric rotation of main bearing 26 within sealed sleeve 24, which preferably contains a few millimeters' depth of lubricating oil in the bottom. Main shaft 22 is sealed with respect to plates 20 and the oil-splashed interior of sleeve 24 by an oil seal 22*a* at its free, motor-driven end protruding from the pump, and by a sealed bearing retainer tension plate 30 bolted to rear plate 20*a* with bolts 30*a* and sealed with an O-ring 30*b*.

It should be noted that front and rear plates 20*a* are substantially identical, except that the bearing pocket 29 in the rear plate is extended to the outer face of the plate to accept bearing retainer tension plate 30 and its O-ring seal 30*b*. It will be apparent to those skilled in the art that front plate 20*a* could be formed in identical fashion provided that oil seal 22*a* or a second bearing retainer tension plate were modified or applied to seal shaft 22 on the front plate.

It will be apparent to those skilled in the art that bearing sleeve 24 not only seals main bearing 26, but further acts as a spacer for front and rear plates 20*a* as they are drawn together and tensioned by bolts 20*d*.

Figure 2A:
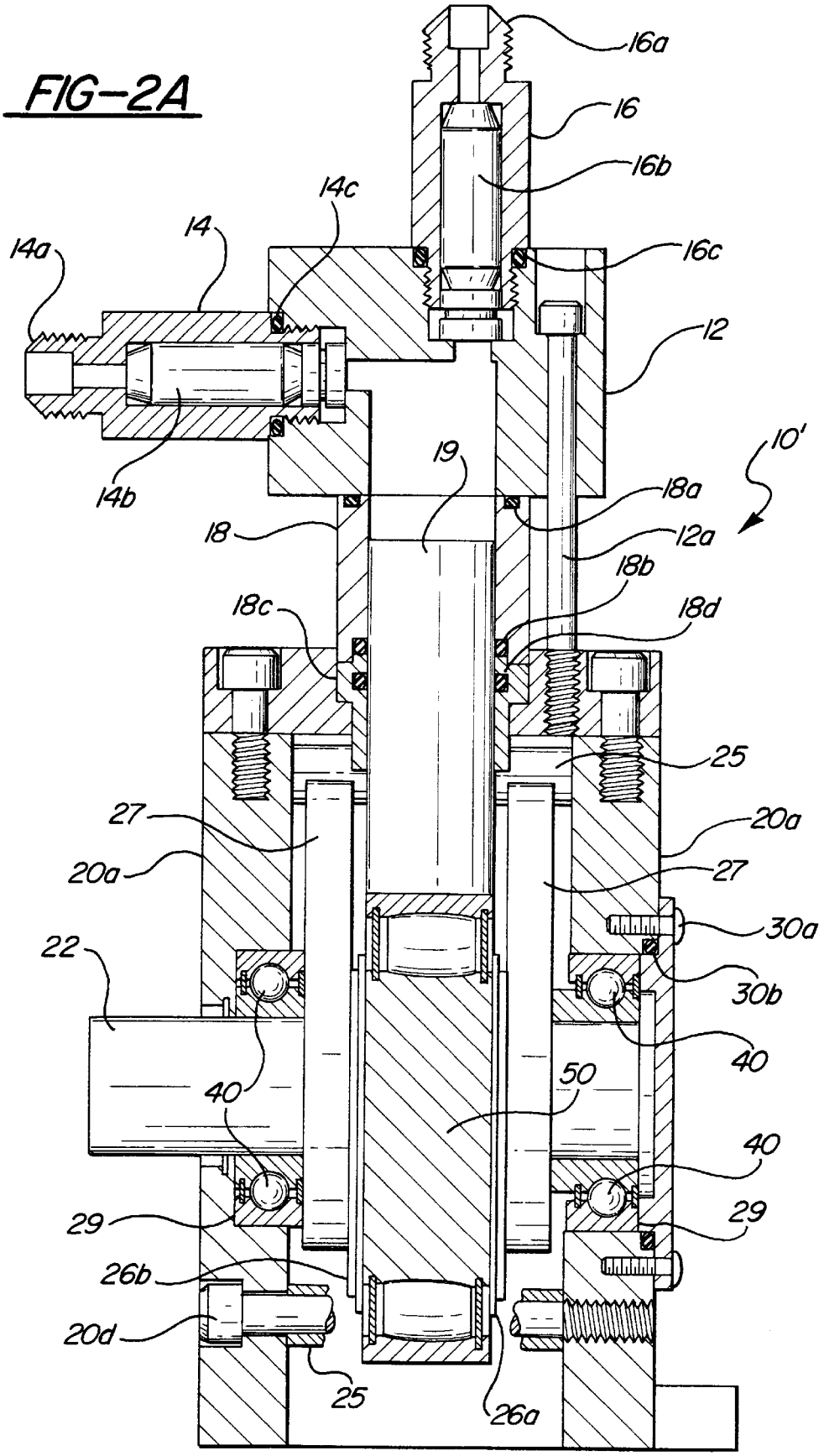
FIG. 2A is an end sectional view of a pump according to the present invention, adapted for oil-free use with the bearing sleeve removed and with sealed main and shaft bearings.
Figure 3:
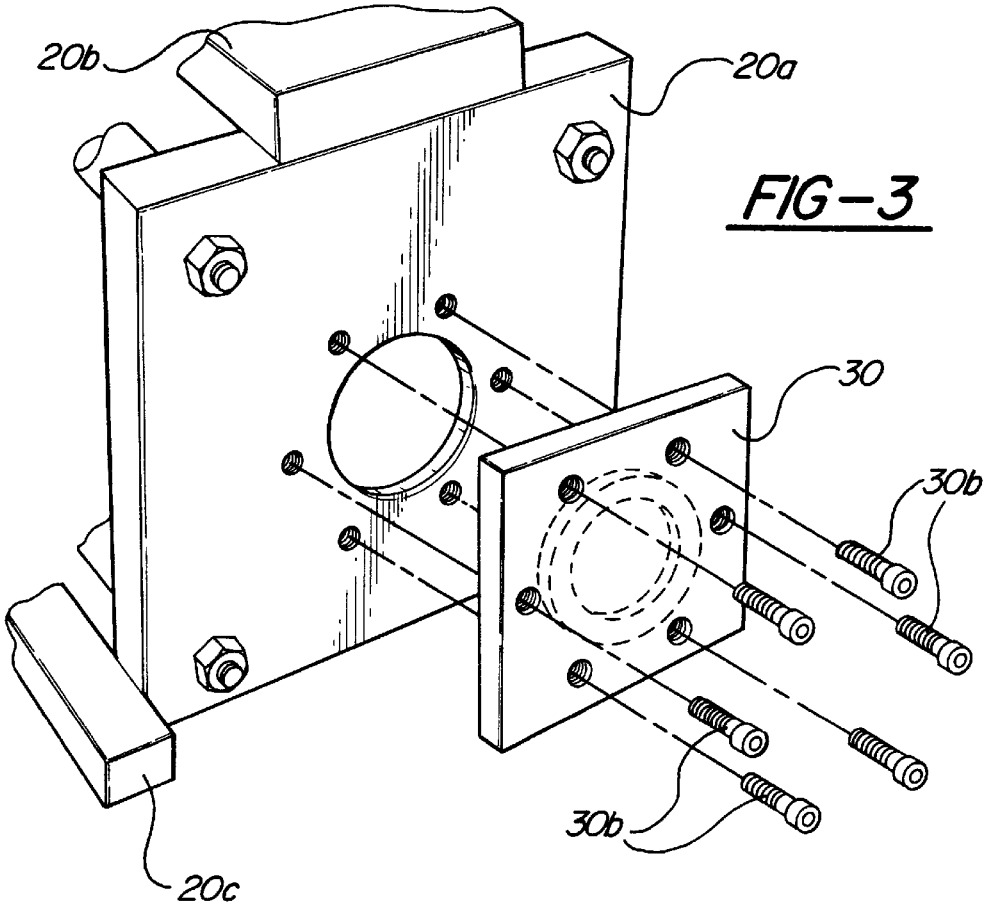
FIG. 3 is an exploded rear perspective view of the bearing frame in the pump according to the invention, showing the bearing retainer tension plate removed.
Figure 4:
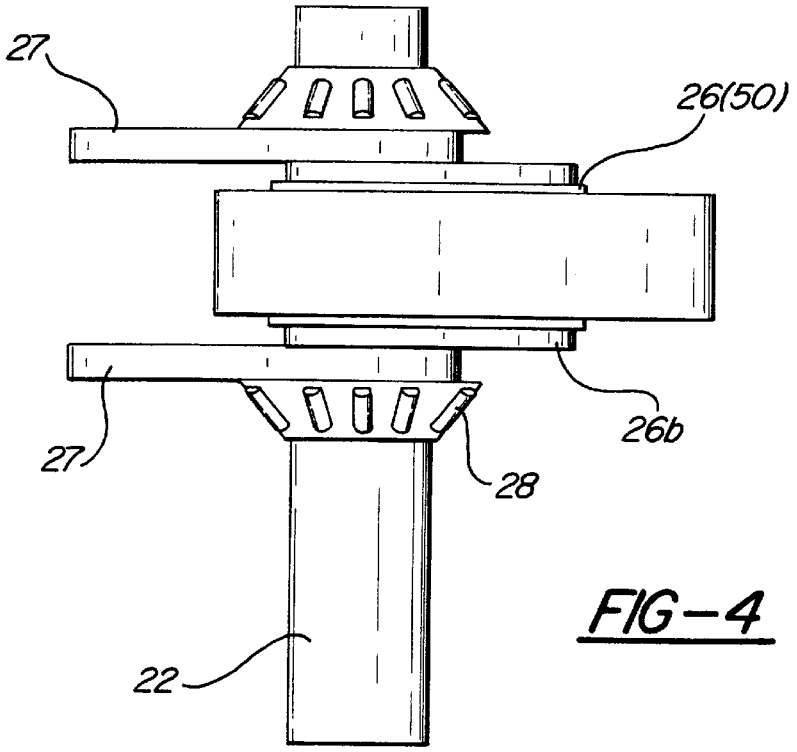
FIG. 4 is a plan view of a preferred type of sealed, self-aligning main bearing used in the pump of the present invention.
Figure 5:
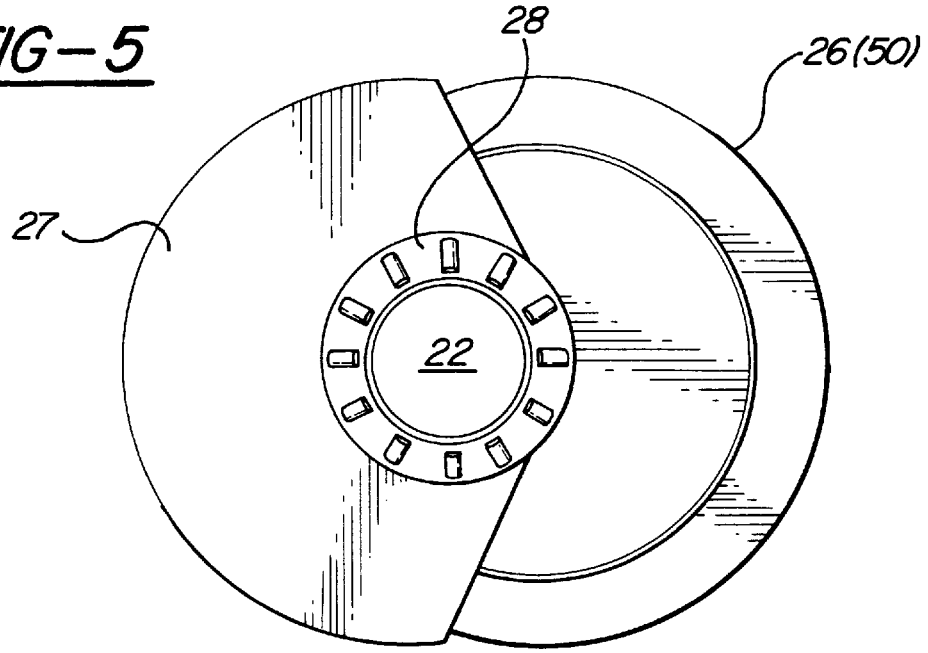
FIG. 5 is a side view of the main bearing of FIG. 4.

Referring next to FIG. 2A, the pump according to the present invention is now referred to as 10' because it has been modified for oil-free operation. In general the pump head, cylinder structure, and bearing frame remain the same and are referred to by the same reference numerals used in FIGS. 1 and 2. The interchangeability of the pump from oil-lubricated operation in FIG. 1 to the oil-free example illustrated in FIG. 2*a* is accomplished by: removing bearing sleeve 24 and replacing it with draw bolt spacers 25; replacing unsealed bearings 28 in FIG. 2 with commercially available sealed bearings 40; and, replacing or converting main bearing 26 to a sealed bearing 50. Neoprene seal 18*e* (FIG. 2) can also be removed from cylinder guide bushing 18*c*, since it is no longer necessary with sleeve 24 removed. Otherwise, the pump assembly remains the same.

Accordingly, simply by replacing shaft bearings 28 with sealed bearings 40, main bearing 26 with sealed bearing 50, and sleeve 24 with draw bolt spacers 25, the pump assembly can be converted between oil-lubricated and oil-free operation by either the manufacturer or the end user at little cost and with little effort. The ease of switching between these two configurations is further simplified by the bolt-together plate design of bearing frame 20.

It will be understood by those skilled in the art that a manufacturer may opt to use a sealed bearing 50 and/or sealed shaft bearings 40 even in the sleeve-sealed, oil-lubricated pump illustrated in FIGS. 1 and 2 to reduce overall inventory, simplify selection for customers, or permit conversion between oil-lubricated and oil-free operation simply by adding or removing bearing sleeves 24 (and any oil). This would be a more expensive option, but in some circumstances might be desirable.

Also, as mentioned above, main bearing 26 may be convertible from an unsealed to a sealed bearing using commercially available convertible bearings. Two commercial sources for sealed and unsealed bearings are NTN Bearing Corporation and McGill Sphere-Rol Bearings. Other sources will be known to those skilled in the art.

The foregoing illustrated embodiments of my invention are specific examples illustrated to enable those skilled in the art to make and use the invention. These specific, illustrated examples are not, however, intended to limit the invention beyond the scope of the following claims, since minor modifications and substitutions to the illustrated structure will be apparent to those skilled in the art without departing from the invention. For example, the dimensions of the pump, the exact nature of many of the seals, the materials used (steel, brass, aluminum), and other matters of design choice will depend on the size and pumping capacity of the pump for particular applications, and the commercial sources for off-the-shelf parts such as main bearings, shaft bearings and seals. Although a vertical application is shown, a horizontal configuration may be used simply by rotating the pump through 90°.

Accordingly, I claim:

1. A pump of the type adapted for pumping fluids from a supply to a storage device, the pump having a pump head with valving operated by a piston reciprocated by an eccentrically driven main bearing mounted below the pump head, the improvement comprising:

an unsealed bearing frame comprising front and rear plates connected by an array of tie rods, the main bearing being sealed peripherally within the tie rods between the front and rear plates.

2. The pump of claim 1, wherein the main bearing is sealed by an external bearing sleeve having front and rear faces abutting inside surfaces of the front and rear plates of the bearing frame under compression from the tie rods, the front and rear faces of the bearing sleeve including seals to contain lubricating oil within the sleeve between the front and rear plates in order to lubricate the main bearing.

3. The pump of claim 2, wherein the main bearing is eccentrically driven by a rotating shaft extending through the front plate of the bearing frame and supported in the rear plate of the bearing frame, the shaft being supported in the rear and front plates on unsealed bearings, the shaft and unsealed bearings being located radially within the sealed bearing sleeve.

4. The pump of claim 1, wherein the main bearing is internally sealed.

5. The pump of claim 4, wherein the sealed main bearing is driven by a rotating shaft extending through the front plate and supported on the rear plate, the shaft being rotatably supported on the front and rear plates by sealed bearings.

6. The pump of claim 4, wherein the tie rods include spacer sleeves which space the front and rear plates under compression.

7. The pump of claim 1, wherein the main bearing is a self-aligning roller type bearing, and the piston floats on the bearing surface, and is held in place by pressure from the pump head.

8. A pump of the type adapted for pumping fluids from a supply to a storage device, the pump having a pump head with valving operated by a piston reciprocated by an eccentrically driven main bearing mounted below the pump head, the improvement comprising:

an open, unsealed bearing frame comprising spaced front and rear plates connected by tie rods and with at least one spacing device between the plates under compression, the main bearing comprising an eccentrically-driven self-aligning bearing sealed internally of the tie rods between the front and rear plates, the main bearing being driven by a shaft rotatably supported on the front and rear plates by shaft bearings, the main bearing including a seal selected from the group consisting of 1) a cylindrical sleeve surrounding the main bearing and sealingly compressed between the front and rear plates within the periphery of the tie rods, and 2) an internal sealing mechanism.

9. The pump of claim 8, wherein the bearings are selected from the group consisting of 1) sealed bearings and 2) unsealed bearings, the unsealed bearings being used with the cylindrical bearing sleeve, and the sealed bearings being used with the internally sealed main bearing, for oil-lubricated and oil-free operation, respectively.

10. The pump of claim 8, wherein the tie rods include individual, unsealed spacer sleeves compressed between the plates when the internally sealed main bearing is selected.

* * * * *

UNITED STATES PATENT AND TRADEMARK OFFICE

CERTIFICATE OF CORRECTION

PATENT NO : 5,983,779

DATED : November 16, 1999

INVENTOR(S) : Ernest K. Romanco

It is certified that error appears in the above-identified patent and that said Letters Patent is hereby corrected as shown below:

Column 3, line 65, change "sleeve 24. Through" to --sleeve 24 through--.

Signed and Sealed this

Twenty-fifth Day of July, 2000

*Attest:*

*Attesting Officer*

Q. TODD DICKINSON

*Director of Patents and Trademarks*